United States Patent [19]

Fogarassy

[11] 4,135,967

[45] * Jan. 23, 1979

[54] PROCESS FOR PRODUCING CELLULOSE PULP BY SOLID PHASE DIGESTION

[75] Inventor: André Fogarassy, Paris, France

[73] Assignee: Societe Generale de Brevets Industriels et Ohimiques, Fribourg, Switzerland

[ * ] Notice: The portion of the term of this patent subsequent to Jun. 3, 1992, has been disclaimed.

[21] Appl. No.: 772,954

[22] Filed: Feb. 28, 1977

Related U.S. Application Data

[63] Continuation of Ser. No. 560,229, Mar. 20, 1975, abandoned, which is a continuation of Ser. No. 341,508, Mar. 15, 1973, Pat. No. 3,887,426, which is a continuation of Ser. No. 74,671, Sep. 23, 1970, abandoned.

[30] Foreign Application Priority Data

Sep. 26, 1969 [CH] Switzerland ..... 14522/69
Dec. 5, 1969 [CH] Switzerland ..... 18197/69

[51] Int. Cl.[2] ..... D21C 3/20

[52] U.S. Cl. ..... 162/29; 162/43; 162/45; 162/63; 162/76; 162/77

[58] Field of Search ..... 162/72, 75, 76, 77, 162/83, 90, 29, 43, 42, 45, 241, DIG. 5, 63; 203/14, 18, 36, 39

[56] References Cited

U.S. PATENT DOCUMENTS

| | | | |
|---|---|---|---|
| 1,735,013 | 11/1929 | Richter | 162/77 |
| 1,790,838 | 2/1931 | Richter et al. | 162/75 |
| 1,833,976 | 12/1931 | Richter et al. | 162/75 |
| 1,856,567 | 5/1932 | Kleinert et al. | 162/77 |
| 1,902,916 | 3/1933 | Strecker | 162/90 |
| 2,003,347 | 6/1935 | Dreyfus | 162/77 |
| 2,022,654 | 12/1935 | Dreyfus | 162/76 |
| 2,698,234 | 12/1954 | Seaman | 162/DIG. 5 |
| 2,772,968 | 12/1956 | Grondal et al. | 162/77 |
| 2,947,657 | 8/1960 | Peteri | 162/76 |
| 3,255,071 | 6/1966 | Kleinert | 162/90 |
| 3,428,520 | 2/1969 | Tiannos | 162/43 |
| 3,479,249 | 11/1969 | Kalisch | 162/72 |
| 3,887,426 | 6/1975 | Fogarassy | 162/29 |

*Primary Examiner*—S. Leon Bashore
*Assistant Examiner*—Peter F. Kratz
*Attorney, Agent, or Firm*—Stevens, Davis, Miller & Mosher

[57] ABSTRACT

Wood chips are digested at a temperature above 100° C in contact with a solution of a hydroxide or salt of an alkali metal or alkaline earth metal or ammonium in a solvent which boils above 100° C at atmospheric pressure, such as ethylene glycol. The cellulose pulp is then separated from the dissolved lignin. The dissolved lignin may be precipitated and removed from the solvent and the solvent may then be recycled, so that there is no waste spent liquor. Examples of salts which may be used are sodium phenoxide and a combination of sodium bisulfite and an aldehyde or a ketone.

11 Claims, 3 Drawing Figures

PROCESS FOR PRODUCING CELLULOSE PULP BY SOLID PHASE DIGESTION

This is a continuation of application Ser. No. 560,229 filed Mar. 20, 1975, now abandoned, which in turn is a continuation of application Ser. No. 341,508, filed Mar. 15, 1973, now U.S. Pat. No. 3,887,426, which is a continuation of application Ser. No. 74,671, filed Sept. 23, 1970, now abandoned.

The subject of the present invention is a process for manufacturing cellulose pulp.

The traditional processes for manufacturing cellulose pulp from wood usually use salts of alkali metals or of alkaline earth metals, or weak acids, for example sulfuric acid or sulfurous acid, in aqueous solution.

These known processes have several disadvantages, in particular they involve digesting the wood for several hours (six to twelve hours), in order to digest the wood completely.

To obtain a sufficiently rapid digestion it must be conducted at temperature of the order of 140° to 150° C, and therefore under a pressure of several atmospheres.

The digestion is usually conducted in rather weak solutions, using a large quantity of water per ton of wood. Subsequently the water has to be distilled away from the resulting liquor in order to recover the reagents.

The production of 1 ton of raw pulp results in the production of 10 $m^3$ of black liquor.

Consequently the reactors are large and complex, and therefore costly.

To produce wood pulp economically a modern pulp mill has to be equipped with digesters and other equipment of enormous size. Furthermore to obtain the necessary high throughput the pulp mill has to be built in a large forested area. This is particularly difficult in Europe, where there are few large forested areas. These very large pulp mills are unsuitable for processing the comparatively small and highly dispersed stands of timber which are characteristic of European conditions.

A further disadvantage of the traditional pulping processes is the emission of large quantities of sulfurous effluent vapors which polute the environment over a radius of more than 10 kilometers.

The technical literature does describe a number of processes for removing the lignin from wood, which are free from some or all of the above disadvantages, but none of these processes are in use on an industrial scale, for various reasons, usually because the reagents are too expensive.

Among these processes Muller describes the extraction of lignin from wood in phenol at 180° C in the presence of small quantities of hydrochloric acid. Huggland and Urban use various alcohols, particularly ethylene glycol in the presence of hydrochloric acid.

In spite of their virtues these processes are not in use industrially, because the phenol and the alcohols, for example glycol, combine with the lignin, under the prevailing operating conditions, to form stable products of the ether type, and consequently a fraction of the reagents cannot be regenerated.

The loss of reagents is excessively costly. Several molecules of alcohol or phenol are lost per molecule of lignin.

The process according to the present invention overcomes most of the difficulties mentioned above, and provides the following advantages:

Very little water is consumed. The consumption of water is limited to the moisture initially present in the wood.

The digestion produces no malodorous effluent gases, and therefore is no atmospheric polution.

No liquid effluents are produced and there is therefore no polution of rivers.

The process can handle all types of wood, from coniferous and deciduous trees.

The reaction is comparatively rapid. The digestion takes only between 30 minutes and 3 hours, depending on the nature of the wood and on the quality of the pulp produced, compared to between 6 and 12 hours by the traditional processes.

The digestion is preferably conducted under atmospheric pressure, whereas in the traditional processes pressures between 4 and 6 kilograms per square centimeter have to be used.

The lignin can be recovered without it being necessary to concentrate the black liquor.

Less solvent is used, compared to the known processes.

Economical pulp production can be obtained using comparatively small processing equipment, and consequently less capital investment is required.

The process according to the invention is characterised in that wood chips are digested at a temperature above 100° C in contact with a solution consisting of a hydroxide or salt of an alkali metal or alkaline earth metal, or of ammonium, dissolved in a solvent consisting of one or more substances which boil at above 100° C under atmospheric pressure, to dissolve the lignin, the resulting cellulose pulp being subsequently separated from the dissolved lignin.

The following salts can be used, although this list of salts is not intended to be limiting:

- sodium phenate
- sodium stearate
- sodium or ammonium bisulfite
- sodium acetate
- calcium bisulfite
- sodium anilide $C_6H_5NHNa$ or other anilides of alkali or alkaline earth metals
- in general sodium or ammonium salts of organic acids or of weak mineral acids can be used.

Preferably there is used as the reactive salt a compound produced by adding a bisulfite of an alkali or alkaline earth metal, or of ammonium, to an aldehyde or a ketone.

Compounds of this kind are sometimes called "bisulfite combinations". They are well known in the field of organic chemistry. It has now been discovered that these compounds are surprisingly advantageous when used for dissolving wood lignin in one of the solvents mentioned in the main patent.

The bisulfite combinations have better thermal stability than the corresponding bisulfites and consequently there is no evolution of sulfurous vapors during the digestion, due to partial decomposition of the reagents, nor during preheating of the solution. The fact that the reagents do not decompose makes it possible to conduct the digestion without excess of reagents, and there is no necessity to recover excess reagent, that is to say reagent which has not reacted, from the black liquor produced during the digestion.

A further advantage is that there is no formation of destructive sulfuric acid by oxidation of liberated $SO_2$.

The bisulfite combinations for use in the process according to the present invention can be derived from aliphatic, aromatic or arylaliphatic aldehydes, the aldehyde being preferably ethanal, or alternatively they can be derived from aliphatic, aromatic or arylaliphatic ketones, preferably methylalcoyl ketones, in particular acetone.

Any solvent can be used in which the above salts are soluble, provided that its boiling point is above 100° C.

To give some non-limiting examples, the following solvents can be used:

monohydroxyl alcohols such as octyl alcohol and lauric alcohol
glycerol
ethylene glycol
anisole
benzyl alcohol
diphenyl
diphenyl oxide
ethers and esters with melting points below 100° C, or mixtures of these solvents.

The process according to the invention can be conducted by either of two methods:

Liquid phase process

The wood chips are suspended in an excess of the solvent containing in solution one or more of the reagents mentioned above.

The whole is heated to a temperature above 100° C, if desired as high as 200° C, for as long as is necessary for completing the lignin removal, the time depending on the type of wood. In general the digestion time can be anything between 30 minutes and 3 hours.

Solid phase process

The wood chips are impregnated, if necessary under vacuum, with the solution containing the reagents.

After allowing the excess solvent to drip off, the impregnated chips are heated, for example by passing steam through the mass, at a suitable temperature during a suitable digestion period.

In both cases the reaction temperature is of the order of 160° to 190° C.

The digestion time can be quite short and is usually not more than 2 hours.

In the liquid phase process the vapors escaping from the tops of the reaction vessels during the digestion are recovered, either by condensation or by compression. The resulting condensates are recycled.

After this liquid phase digestion, the cellulose pulp is separated from the black liquor by filtration.

To the black liquor there is added an aqueous solution of calcium hydroxide, producing a precipitate of calcium lignate, which is separated from the glycol by filtration. Alternatively the lignin can be precipitated by adding to the black liquor a strong acid, for example hydrochloric acid, producing a precipitate of insoluble lignin-sulfonic acid.

The recovered lignin can if desired be used directly as a fuel, in the manner known to the pulp industry.

The recovered solvent, after readjustment of the concentrations of reagents, is reused for digesting a further batch of wood chips.

The raw pulp produced in this way is washed and can then be subjected to the customary treatment. The raw cellulose pulp can be bleached, for example, by the electrolytic bleaching process.

In the solid phase process the digested mass is washed with water and filtered, the effluent wash waters being treated as described above, that is to say the lignin is precipitated as calcium lignate, which is removed from the liquid by filtration.

The drawing represents diagrammatically, as examples, three installations for operating the process according to the invention.

Figure 1:
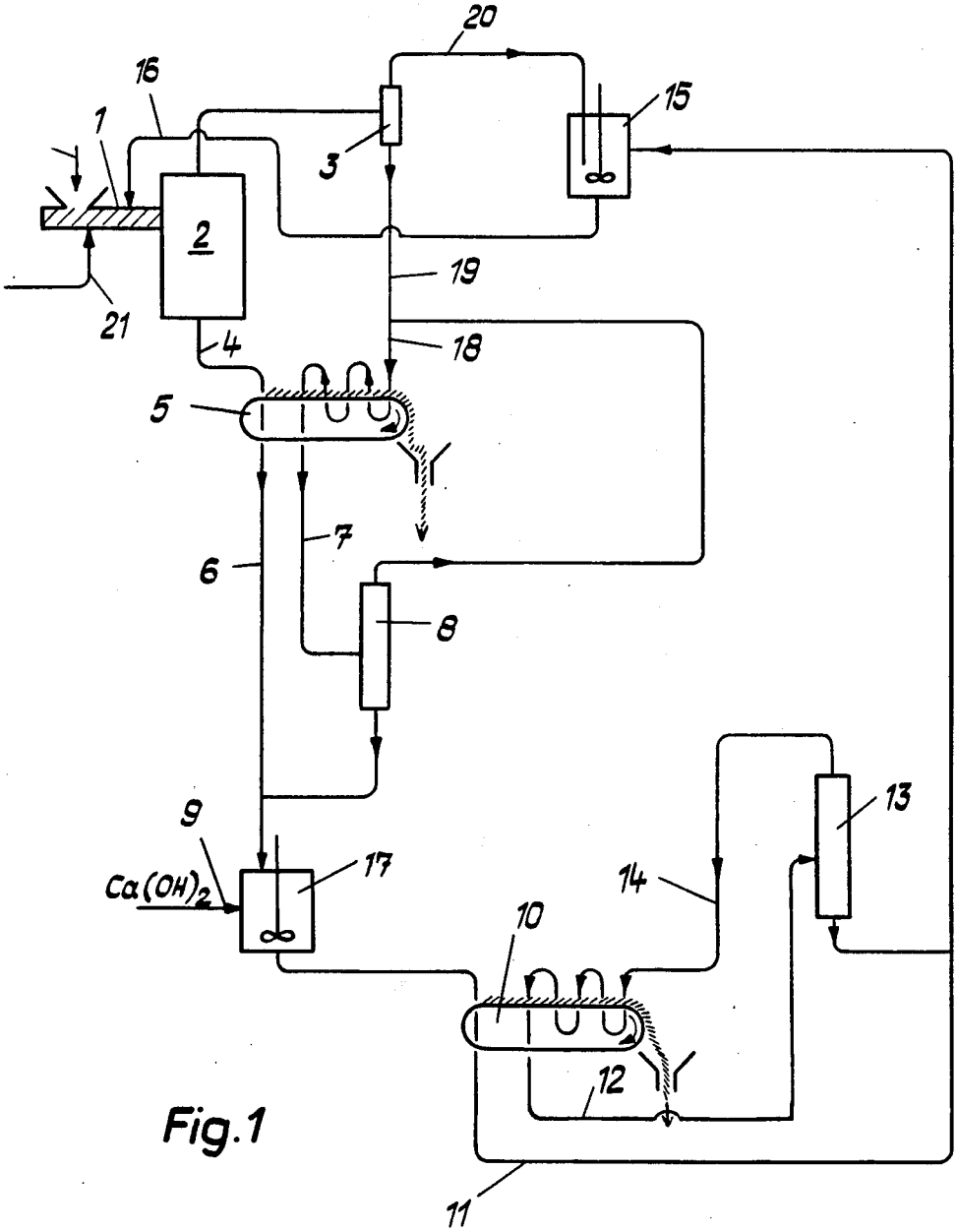
FIG. 1 shows a first installation.

The plant represented diagrammatically in FIG. 1 is for operating the process according to the invention by the liquid phase method. Operation is continuous. The wood chips are digested in a glycol solution.

The chips are fed into a mixer 1, where they are mixed with a recycled solution of sodium bisulfite in ethylene glycol, which is introduced through the pipe 16. The suspension of wood chips in glycol solution is fed into a reactor 2, which is heated to a temperature of 170° to 180° C by means not shown. In the reactor 2 the chips are digested for approximately 1¼ hour at atmospheric pressure.

During the digestion the moisture initially in the wood escapes from the top of the reactor, loaded with the sulfurous vapors produced by the reaction, and is condensed in a condenser 3.

The digestion products are removed from the reactor through a pipe 4 and filtered on a continuous filter 5. The filtrate contains alkaline lignin in solution in glycol. This solution is fed through a pipe 6 into a mixer 17. The cellulose pulp collected on the filter 5 is washed by a counter-current stream of water arriving through a pipe 18. The effluent wash waters from the filter 5 are conveyed through a pipe 7 into a distillation column 8. The head fraction from the column 8 is condensed, by means not shown, the resulting condensed water being recycled for washing the cellulose pulp, further water for washing arriving through the pipe 18 in the form of all or part of the water condensed in the condenser 3. The tail fraction from the distillation column 8 is a solution of alkali-lignin in glycol. This is added to the filtrate flowing through the pipe 6. The crude cellulose pulp, after removing from the filter, can be used as it is, or for example bleached in the known way, if desired by the electrolytic bleaching process.

In the mixer 17 there is added to the glycol filtrate through the pipe 9 an aqueous solution of calcium hydroxide, containing the stoichiometric quantity of calcium for reacting with all the lignin. There is formed a precipitate of calcium lignate, which is recovered on a continuous filter 10, where the precipitate is washed by a counter-current stream of water arriving through the pipe 14. The glycol filtrate, containing sodium hydroxide formed during the reaction between the calcium hydroxide and the lignin, leaves the filter through a pipe 11. The wash waters leaving the continuous filter 10 are conveyed through a pipe 12 to a distillation column 13. The head fraction from the column 13 is condensed (by means not shown), giving distilled water which is recycled through a pipe 14 for washing the calcium lignate on the filter 10. The tail fraction from the column 13 consists essentially of sodium hydroxide in solution in ethylene glycol. This solution is added to the filtrate flowing through the pipe 11, the combined filtrates being fed to a mixer 15, in which the alkali in the glycol solution is allowed to combine with $SO_2$ arriving through a pipe 20. This is the $SO_2$ produced in the reactor 2. It reaches the mixer 15 through the pipe 20 after passing uncondensed through the condenser 3. The sodium bisulfite in glycol solution regenerated in the mixer 15 is fed back through the pipe 16 to the mixer 1 and then passes into the reactor 2, as already described above.

Thus both the reagent sodium bisulfite and the solvent glycol circulate around a closed circuit and are constantly reused. To make up the inevitable losses, fresh reagent and solvent are introduced through a feed pipe 21 into the mixer 1.

Usually the moisture removed from the system in the cellulose pulp and the moist calcium lignate is balanced by the moisture entering the system in the wood chips. However water can when necessary be introduced or removed through taps in the pipe 18.

Figure 2:
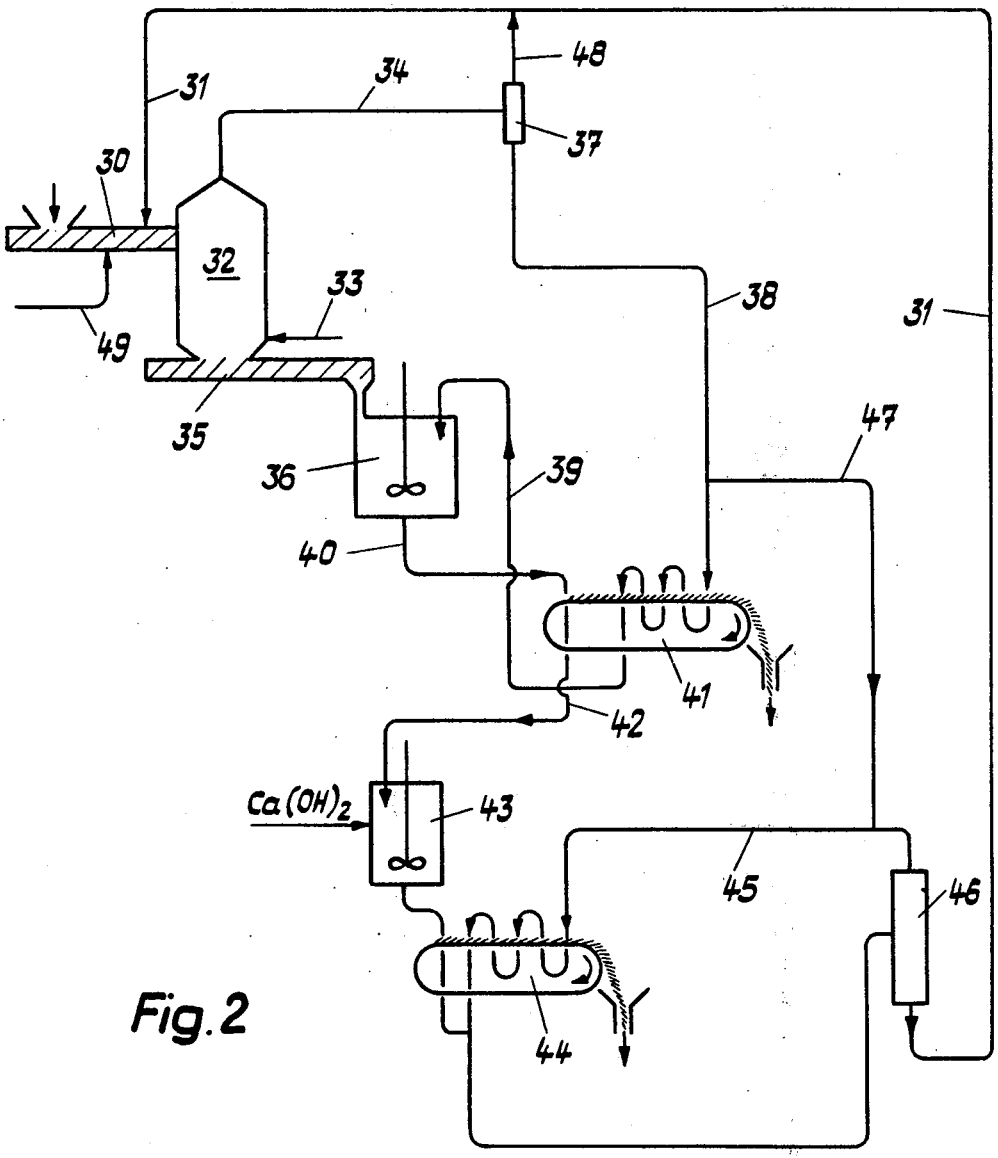
FIG. 2 shows a second installation.

The apparatus shown in FIG. 2 is for manufacturing cellulose pulp by the solid phase process, the plant operating continuously. The chips are fed into the system through a worm feeder 30, in which they are wetted by a recycled solution of sodium phenate in ethylene glycol, which arrives through a pipe 31. Just enough solution is added to impregnate the chips, all the solution being absorbed by the wood. The solution contains the highest possible concentration of sodium phenate, so as to minimize the quantity of liquid which has to be added to the wood.

The mass of impregnated wood chips is fed continuously into a reactor 32, where it is heated to a temperature of 160° to 190° C by steam passed counter-current through the mass. The steam is fed at atmospheric pressure into the base of the reactor through a steam pipe 33, the effluent steam escaping from the top of the reactor through a pipe 34.

The chips are digested in the reactor 32 for approximately 1½ hour. The contents of the reactor 32 are then removed by a worm conveyor 35, which feeds the material into a disperser 36.

The vapors from the digestion escape from the top of the reactor 32 through a pipe 34 to a condenser (not shown). The condensate passes into a phase separator 37, which splits the condensate into two liquids, a supernatant phase, which consists of phenol, which is a by-product of the reaction, and a subjacent liquid phase which consists of water. The water flows out of the phase separator through a pipe 38.

In the disperser 36 the digested pulp is dispersed in a dilute aqueous solution of alkali-lignin which arrives from the filter through a pipe 39. The suspension thus formed flows from the disperser 36 through a pipe 40 to a continuous filter 41, which removes the raw pulp. On the filter 41 the raw cellulose pulp is washed in a counter-current stream of water which reaches the filter through the pipe 38. This wash water, after passing through the pulp, is fed through the pipe 39 to the disperser 36, as already mentioned.

The filtrate from the filter 41 contains a high concentration of alkali-lignin. This liquid flows from the filter 41 through a pipe 42 to a mixer 43, where it is mixed with a stoichiometric quantity of calcium hydroxide, with the result that the lignin is precipitated as calcium lignate, the alkali being liberated. The precipitate of calcium lignate is recovered on a continuous filter 44, where it is washed in a counter-current stream of distilled water arriving through a pipe 45. The aqueous filtrate is fed, together with the effluent wash water, to a distillation column 46. The head fraction from the column 46 is condensed, by means not shown, the condensate being fed into the pipe 45, where it is joined by a stream of water flowing through a pipe 47. This stream of water, flowing through the pipe 47, is excess wash water which is not required for washing the cellulose pulp on the filter 41. The pipe 47 branches off from the pipe 38.

The tail fraction from the distillation column 46 consists essentially of a solution of sodium hydroxide in ethylene glycol. This solution is fed through a pipe 31 and is mixed with the supernatent phenolic phase arriving through a pipe 48 from the phase separator 37. The phenol combines with the sodium hydroxide to form sodium phenate. The resulting liquid, containing sodium phenate in ethylene glycol, is fed into the worm conveyor 30 for mixing with the raw wood chips, as mentioned at the beginning.

Fresh solvent and reagent, for compensating the inevitable losses, is fed to the conveyor worm 30 through a supply pipe 49, as already described for the apparatus of FIG. 1.

The steam introduced into the digester 32 through the steam pipe 33 is usually an excess, that is to say water is introduced into the system faster than it is removed as moisture in the cellulose pulp and in the calcium lignate. The excess water is removed through a drain pipe (not shown) connected to one of the water pipes 38, 45, 47.

Figure 3:
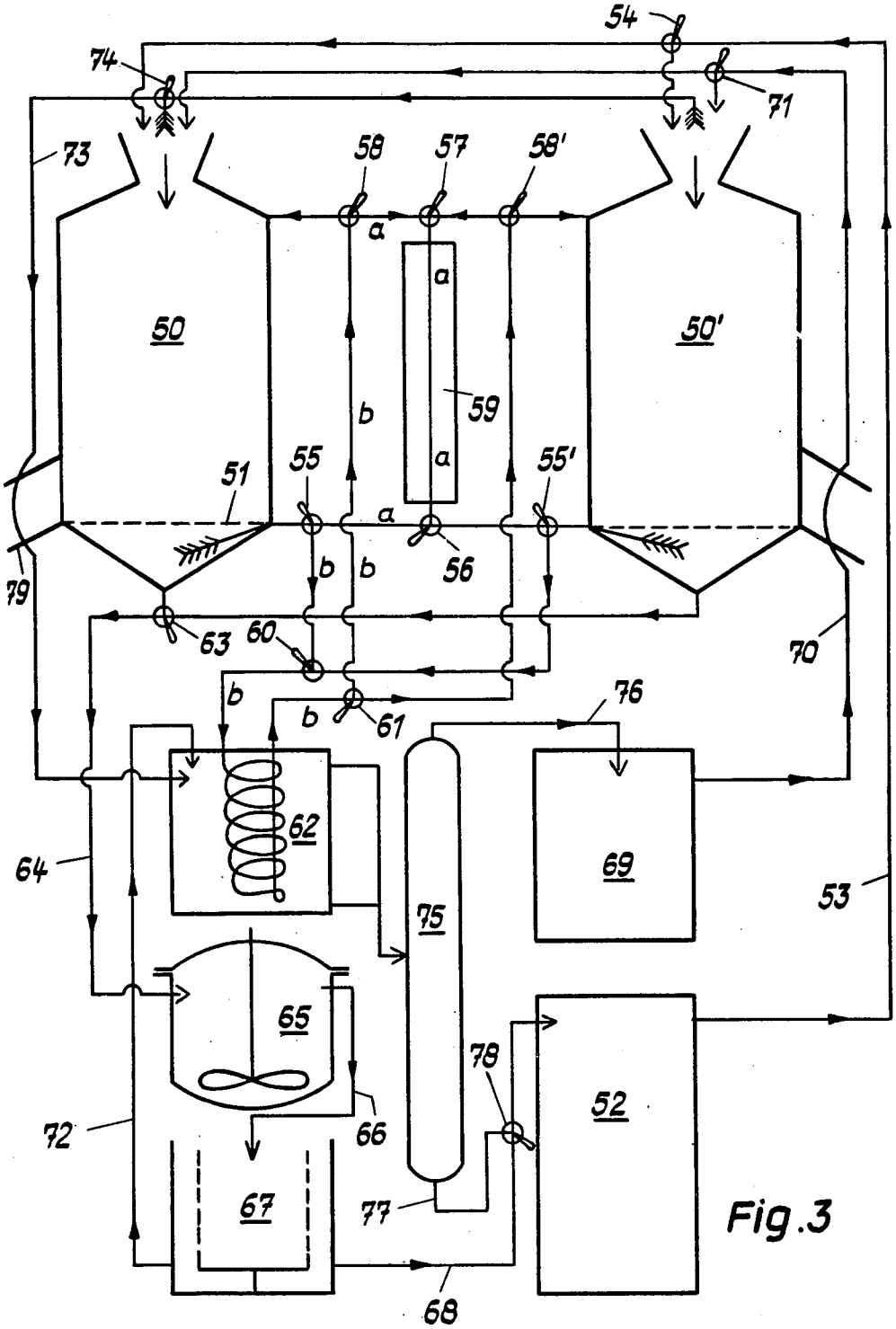
FIG. 3 shows a third installation.

There will now be described, on the basis of FIG. 3, a plant for the semi-continuous production of cellulose pulp by digestion of wood chips suspended in a glycolic solution. The output is 15 tons of cellulose pulp per day. The wood chips are charged into a digester 50. To the wood chips in the digester 50 there is added 10 $m^3$ of ethylene glycol containing in solution 10% by weight of sodium phenate, as the reagent. This solution reaches the digester 50 from a storage tank 52 through a pipe 53 equipped with a valve 54. When the digester 50 has been charged, the liquid phase is circulated around in a closed circuit, the stream of liquid flowing through the mass of wood chips, out through the bottom of the digester 50 and around the closed circuit marked *a* in the drawing, the liquid passing through the valves 55, 56, 57, 58, and through a heater 59, which heats the liquid to a temperature between 160° and 190° C and maintains this temperature during the duration of the digestion. The liquid is circulated by a pump which is not shown in the drawing.

When the digestion has been completed, the temperature of the material in the digester 50 is lowered to 80° to 90° C. To lower the temperature the valves are actuated so that the circulating liquid no longer passes through the heater 59, that is to say the valves 55, 58, 60, 61 are actuated so that the liquid, which is an organic alkali-lignin solution, now circulates through the closed circuit *b*, passing through a heat exchanger 62. As soon as the contents of the digester 50 have been cooled sufficiently, a valve 63 is actuated, allowing the lignous solution to flow through a pipe 64 into a mixer 65. To the lignous liquid in the mixer 65 there is added a quantity of calcium hydroxide, with the result that the lignin is precipitated in the form of calcium lignate, with regeneration of reagent alkali.

The contents of the mixer 65 are subsequently discharged through a pipe 66 into a centrifugal filter 67. The calcium lignate is retained on the filter. The filtrate, containing alkali regenerated by the calcium reaction, passes through a pipe 68 into the storage tank 52.

After the concentration of sodium phenate in the ethylene glycol has been readjusted, the reagent liquid in the storage tank 52 is used to digest a further batch of wood chips, the reagent liquid flowing through the pipe 53 and, this time, through a valve 54 into the second digester 50', which by now contains a further charge of wood chips. During this digestion in the digester 50', the digested cellulose pulp which has been retained on the screen 51 in the first digester 50 is washed as follows. Hot water from a hot water storage tank 69 flows through the pipe 70 and through a valve 71 into the digester 50, washing the cellulose pulp. The effluent wash water leaves the digester 50 through the valve 63 and, passing through the pipe 64 reaches the mixer 65. This effluent wash water contains alkali lignin and residual organic solvent. In the mixer 65 calcium hydroxide is added to the effluent wash water, precipitating the lignin as calcium lignate. The contents of the mixer 65 are subsequently discharged through the pipe 66 into the centrifugal filter 67.

In the centrifugal filter 67 the residual lignin in the wash water is removed in the form of calcium lignate, which remains on the filter. The filtrate, which is purified wash water, is sent through a pipe 72 into the heat exchanger 62, where it acts as a coolant for cooling the alkali lignin organic solution produced during the digestion.

After passing through the heat exchanger 62 the purified wash water, partly in the form of vapor, is fed to a fractionating column 75, which performs the following separation:

From the head of fractionating column 75 distilled water is returned through a pipe 76 to the storage tank 69.

From the tail of fractionating column 75 ethylene glycol is returned through a pipe 77 and a valve 78 into the storage tank 52.

After the cellulose pulp has been washed on the screen 51 in the digester 50, it is removed through an outlet 79, after which it can be bleached in the known way. The digester 50 is now empty and can be used for digesting a further batch of wood chips. During the digestion of this further batch in the digester 50, the cellulose pulp is being washed in the digester 50', and so on, the cycles being repeated. Although FIG. 3 shows only two digesters 50, 50', the system can of course if desired contain more than two digesters. The same quantity of reagent, organic solvent and wash water is reused again and again, apart from inevitable losses.

It should be observed that a part of the sodium phenate is recovered in the distillate leaving the digester during each digestion. Another part of the sodium phenate is converted into calcium phenate mixed with the calcium lignate. The phenol can be recovered from this by reacting the calcium phenate with $CO_2$ (by means not shown in the drawing), the phenol being recovered by entrainment in steam.

The plant can be operated at an average throughput of approximately 1 digester charge every 3 hours, the plant producing approximately 15 tons per day of dry cellulose pulp. The same quantity of solvent is reused constantly, passing from one digester to the other.

To summarize, using only 10 $m^3$ of solvent, a production of 15 tons of dry cellulose pulp is obtained per 24 hours. This excellent result is due essentially to the following facts:

The digestion period proper is only 3 hours.

The same body of solvent is used again and again, the solvent being passed repeatedly from the one digester to the other. The water also circulates repeatedly around a closed circuit, the water also being passed repeatedly from the one digester to the other.

The number of batches digested per day is:

24/Duration of digestion, hours.

To keep the plant in operation continuously, the digestions following each other without interruption, the number of digesters required is:

Duration of one complete cycle of operations/Duration of digestion.

For example:

Let it be assumed that one complete cycle of operations occupies 9 hours, and that the digestion period is 3 hours. The number of digesters required is:

$9/3 = 3.$

These considerations are of fundamental importance in regard to the technology of the installation, in view of the fact that to produce 15 tons per day of cellulose pulp in a conventional installation, using only a single digester, involves the consumption of 150 $m^3$ of water.

The process according to the invention will now be illustrated by means of the following non-limiting examples:

EXAMPLE 1

Into a flask equipped with a reflux condenser there were charged 10 g of pine chips, 6 g of sodium phenate and 100 ml of ethylene glycol, and the whole was heated to 185° C for 1 hour at atmospheric pressure. After the digestion the contents were removed from the flask and the cellulose pulp separated from the black liquor. The raw pulp was washed, dried and weighed. The yield was 4.8 g of crude cellulose pulp, which was easy to bleach.

A quantity of calcium hydroxide was added to the black liquor, precipitating calcium lignate, which was separated by filtration. There were recovered 86 ml of glycol.

EXAMPLE 2

Proceeding as described for Example 1, a mixture consisting pf 10 g of birch chips, 6 g of sodium phenate and 100 ml of glycerol was heated at a temperature of 180° to 190° C for 40 minutes. After treating the digested material as described for Example 1, the yield obtained was 4.6 g of dry cellulose pulp with very little coloration, and 80 ml of solvent.

EXAMPLE 3

Proceeding as described for Example 1, 10 g of pine chips, 10 g of sodium anilide and 100 ml of ethylene glycol were heated at 185° to 190° C for 1 hour. After treating the digested mass as described for Example 1, there were obtained 4.7 g of crude dry cellulose pulp easy to bleach, and 80 ml of recovered solvent.

In order to provide a basis for comparisons, the experiment was repeated using 10 g of aniline instead of the sodium anilide. The yield was 7.4 g of dry crude cellulose pulp, instead of the 4.7 g previously obtained, indicating incomplete removal of lignin.

EXAMPLE 4

Proceeding as described for Example 1, 10 g of fir chips, 2 g of sodium hydroxide pellets and 4.6 g of aniline in 100 ml of glycerol were heated. In this example the aniline reacts with the sodium hydroxide in situ, forming sodium anilide.

After treating the reacted mass as described for Example 1, there were finally obtained 4.8 g of crude cellulose pulp, easy to bleach.

EXAMPLE 5

Proceeding as described for Example 1, a mixture was heated consisting of 10 g of beech chips, 3 g of sodium phenate, 8 g of sodium stearate, 30 ml of benzyl alcohol and 70 ml of ethylene glycol, at a temperature of 180° to 190° C for 1 hour.

At the end of the treatment the reacted mass was processed as described for Example 1. The final yield was 4 g of dry crude pulp.

EXAMPLE 6

Proceeding as described for Example 1, a mixture was heated consisting of 10 g of poplar chips, 1 g of sodium hydroxide pellets, 8 g of sodium stearate and 100 ml of glycerol, at a temperature of 170° to 180° C for 1½ hour.

After the digestion the contents of the flask were treated as described for Example 1, giving a final yield of 5.4 g of dry crude pulp.

EXAMPLE 7

Proceeding as described for Example 1, a mixture consisting of 10 g of fir chips, 1 g of sodium hydroxide pellets, 3 g of sodium phenate and 100 ml of ethylene glycol was heated at 180° to 190° C for 80 minutes.

After treating the digested mixture as described for Example 1 there was finally obtained a yield of 4.8 g of dry raw cellulose pulp, very easy to bleach.

EXAMPLE 8

Proceeding as in Example 1, a mixture consisting of 10 g of pine chips, 5 ml of an aqueous solution of sodium bisulfite of density 36° Be, and 100 ml of glycerol was heated at 140° to 160° C for 1½ hour.

After treating the digested mass as in Example 1, the yield was 4.6 g of dry raw cellulose pulp, very light in color.

EXAMPLE 9

Proceeding as in Example 1, a mixture consisting of 10 g of oak chips, 6 g of sodium phenate, 30 ml of lauric alcohol and 70 ml of ethylene glycol was heated at 180° to 190° C for 2 hours.

After treating the digested mixture as in Example 1 the yield was 3.6 g of dry pulp, easy to bleach.

EXAMPLE 10

Into a reaction flask equipped with a descending condenser there were introduced 10 g of fir chips and 100 ml of ethylene glycol containing 10% by weight of a sodium acetone-bisulfite combination. The mixture was heated to 180° to 185° C and held at this temperature for 30 minutes. Evolution of vapors and sulfurous gases occured during the heating. After the digestion the reacted mass was filtered to separate the cellulose pulp from the black liquor. The pulp was washed and dried.

The yield was 4.3 g of dry cellulose pulp, very light in color and easy to bleach.

Addition of calcium hydroxide to the black liquor did not result in complete precipitation, which seems to indicate that the lignin is present in the black liquor in the form of bisulfite combinations. However complete precipitation is obtained by adding hydrochloric acid.

EXAMPLE 11

Proceeding as described in Example 10, a mixture consisting of 10 g of wood chips in 100 ml of pure ethylene glycol was heated at 180° to 185° C. During the heating 5 g of a sodium acetone-bisulfite combination was added gradually with agitation of the mixture. The whole was held for 20 minutes at 180° to 185° C. After filtering, washing and drying there was obtained 4.4 g of cellulose pulp, showing very little discoloration. The pulp was easy to bleach. In this experiment the method of operation made it possible to use only half the quantity of reagent necessary in Example 10, by preventing decomposition of the reagent during the heating period.

EXAMPLE 12

Proceeding as described for Example 11, 10.0 g of fir chips were reacted with 5.0 g of a sodium ethanal-bisulfite combination.

The yield was 4.2 g of dry cellulose pulp.

EXAMPLE 13

Proceeding as in Example 11, 10.0 g of birch chips were reacted with 2.5 g of a sodium ethanal-bisulfite combination.

The yield was 4.1 g of crude cellulose pulp.

The same results were obtained using the same quantity of a sodium acetone-bisulfite combination, instead of the sodium ethanal-bisulfite combination.

EXAMPLE 14

Proceeding as in Example 11, 10 g of beech chips were reacted with 5 g of a sodium acetone-bisulfite combination.

The yield was 3.6 g of crude cellulose pulp.

EXAMPLE 15

Proceeding as in Example 11, 10 g of oak chips were reacted with 5 g of a sodium acetone-bisulfite combination.

The yield was 3.2 g of a crude cellulose pulp which was more discolored than that obtained in Example 11, but was easy to bleach.

EXAMPLE 16

Proceeding as in Example 11, 10 g of pine chips were reacted with 5 g of calcium ethanal-bisulfite combination.

The yield was 4.2 g of crude cellulose pulp.

EXAMPLE 17

Proceeding as in Example 11, 10 g of fir chips were reacted with 5 g of a calcium acetone-bisulfite combination.

The yield was 4.4 g of a crude cellulose pulp.

EXAMPLE 18

Proceeding as in Example 11, 10 g of a fairly discolored cellulose pulp was used. This pulp had previously been incompletely delignified by an alkaline process. The crude pulp was reacted with 2 g of a sodium acetone-bisulfite combination.

There was obtained as the yield 7.4 g of a very pure crude cellulose pulp, very light in color and easy to bleach.

The experiment was repeated using, as the reagent, 2 g of a sodium ethanal-bisulfite combination. The yield was 7.8 g of a purified crude cellulose pulp.

I claim:

1. In a process for producing cellulose pulp comprising digesting wood chips by heating the wood chips at a temperature above 100° C in contact with a concentrated solution of a hydroxide or salt of an alkali metal, alkaline earth metal or ammonium in a solvent which consists of one or more substances which have boiling points above 100° C under atmospheric pressure and selected from the group consisting of monohydroxy alcohols, ethylene glycol and glycerol to solubilize the lignin and then separating the cellulose pulp from the solubilized lignin, the improvement consisting of heating the wood chips in contact with an amount of said solution such that substantially all the solution is absorbed by the wood, said amount of absorbed solution being obtained by impregnating the wood chips with said concentrated solution and allowing any excess solution to drain off prior to heating, and said heating step being carried out in a solid phase such that said wood chips are not suspended in said concentrated solution.

2. Process as claimed in claim 1, wherein the digestion is conducted under atmospheric pressure.

3. Process as claimed in claim 1 wherein said monohydroxy alcohol is benzyl alcohol.

4. Process as claimed in claim 2, wherein that the solvent used is ethylene glycol.

5. Process as claimed in claim 1, wherein the salt is selected from the group consisting of sodium phenate, sodium stearate, sodium bisulfite, ammonium bisulfite, calcium bisulfite, sodium acetate, and sodium anilide.

6. Process as claimed in claim 5, wherein the salt is sodium phenate.

7. Process as claimed in claim 5, wherein the salt is sodium stearate.

8. Process as claimed in claim 5, wherein the salt is sodium anilide.

9. Process as claimed in claim 1, wherein the salt is a compound produced by adding a bisulfite of an alkali metal or alkaline earth metal or ammonium to an aldehyde or a ketone.

10. Process as claimed in claim 1, wherein the following operations are conducted in the form of a continuous manufacturing process: wood chips impregnated with the above solution are charged into a digester, the mixture is digested at a temperature maintained above 100° C, the digested mixture is removed from the digester, the mixture being in the form of a solid mass consisting of cellulose pulp impregnated with a solution containing lignin, the pulp is dispersed in the effluent wash waters from the subsequent pulp filtration, forming a suspension of cellulose pulp in an aqueous solution containing lignin, the resulting mixture is filtered, the yield of cellulose pulp is washed with water on the filter, the effluent wash waters being used for the dispersion mentioned above, to the filtrate there is added calcium hydroxide, which precipitates the lignin in the form of a suspension of calcium lignate, the mixture is filtered, the yield of calcium lignate is washed with water, the effluent wash waters are combined with the filtrate, the mixed liquids are distilled, the resulting distilled water is the water used for washing the calcium lignate on the filter, the tail fraction from the distillation is recycled and used as the solvent for impregnating the wood chips.

11. Process as claimed in claim 10, characterized in that, using sodium phenate as the reagent, the mixture is digested by live steam introduced into the digester, the water vapor loaded with phenol leaving the digester is condensed, the resulting condensate is separated into two phases, of which the aqueous phase is used for washing the yield of cellulose pulp, the phenolic phase being combined with the recycled solvent, which contains sodium hydroxide, in order to regenerate sodium phenate in the solvent.

* * * * *

UNITED STATES PATENT AND TRADEMARK OFFICE

CERTIFICATE OF CORRECTION

PATENT NO. : 4,135,967
DATED : January 23, 1979
INVENTOR(S) : Andre FOGARASSY

It is certified that error appears in the above-identified patent and that said Letters Patent are hereby corrected as shown below:

The correct name of the Assignee should be"Société Générale de Brevets Industriels et Chimiques"

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*